US006604797B2

(12) United States Patent
Lehmann et al.

(10) Patent No.: US 6,604,797 B2
(45) Date of Patent: Aug. 12, 2003

(54) ROTARY STORAGE UNIT WITH MOTORIZED LATCH ACTUATOR

(75) Inventors: Steven M. Lehmann, Fort Atkinson, WI (US); Robert A. Housh, East Troy, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 7 days.

(21) Appl. No.: 09/783,699

(22) Filed: Feb. 14, 2001

(65) Prior Publication Data

US 2002/0109443 A1 Aug. 15, 2002

(51) Int. Cl.[7] ..... E05C 7/06

(52) U.S. Cl. ..... 312/222; 312/305; 312/319.8; 292/196

(58) Field of Search ..... 312/312, 222, 312/326, 319.5, 319.7, 319.8, 125, 135, 305; 108/20; 292/139, 97, 196

(56) References Cited

U.S. PATENT DOCUMENTS

| | | | | | |
|---|---|---|---|---|---|
| 3,868,157 | A | | 2/1975 | Robinson | |
| 4,229,060 | A | | 10/1980 | Brownlee et al. | |
| 4,258,966 | A | * | 3/1981 | Grubb, Jr. | 108/139 |
| 4,317,604 | A | * | 3/1982 | Krakauer | 312/125 |
| 4,340,263 | A | * | 7/1982 | Webb | 312/134 |
| 4,449,764 | A | * | 5/1984 | Hastings | 261/106 |
| 4,485,997 | A | | 12/1984 | Potter | |
| 4,587,908 | A | | 5/1986 | DeBruyn | |
| 4,588,236 | A | | 5/1986 | Potter | |
| 4,610,492 | A | | 9/1986 | Molander et al. | |
| 5,158,345 | A | * | 10/1992 | Baur | 312/319.6 |
| 5,312,181 | A | | 5/1994 | Hudnall | |
| 5,456,530 | A | | 10/1995 | Blaize | |
| 5,494,347 | A | | 2/1996 | Poortvliet et al. | |
| 5,547,273 | A | | 8/1996 | Hudnall | |
| 5,553,865 | A | * | 9/1996 | Shoemaker et al. | 108/20 |
| 5,749,556 | A | | 5/1998 | Matsuoka et al. | |

OTHER PUBLICATIONS

Installation Procedures, PivotFile™ Rotary Storage, Spacesaver Corporation, 1450 Janesville Avenue, Fort Atkinson, Wisconsin 53538–2798, Rev 1.0/SC–9930, KCC/KCC 8/99.

Installation Instructions, PivotFile™ Rotary Storage, Spacesaver Corporation, 1450 Janesville Avenue, Fort Atkinson, Wisconsin 53538–2798, Rev 1.0/OP–9994 SSC/ECONO 6/00.

* cited by examiner

*Primary Examiner*—Lanna Mai
*Assistant Examiner*—Jerry A. Anderson
(74) *Attorney, Agent, or Firm*—Boyle, Frederickson, Newholm, Stein & Gratz, S.C.

(57) ABSTRACT

A rotary storage unit includes a cabinet defining an interior within which a rotary storage member is located. A latch mechanism is mounted to the cabinet, and selectively engages the rotary storage member for maintaining the storage member in either an open position or a closed position. A motorized actuator arrangement is interconnected with the latch mechanism, for selectively moving the latch mechanism between a latching position and a release position. The motorized actuator arrangement includes a motor which imparts movement to an actuator rod interconnected with the latch mechanism, for moving the latch mechanism between its latching and release positions in response to axial movement of the actuator rod. The motor moves the actuator rod so as to return the latch mechanism to its latching position after expiration of a predetermined time delay. The actuator rod is interconnected with a spring which biases the latch mechanism toward its latching position, to provide a positive stop when the storage member is moved to a predetermined position relative to the cabinet. The motorized actuator arrangement is operable in response to operation of a hand-operable switch mounted to the cabinet.

19 Claims, 5 Drawing Sheets

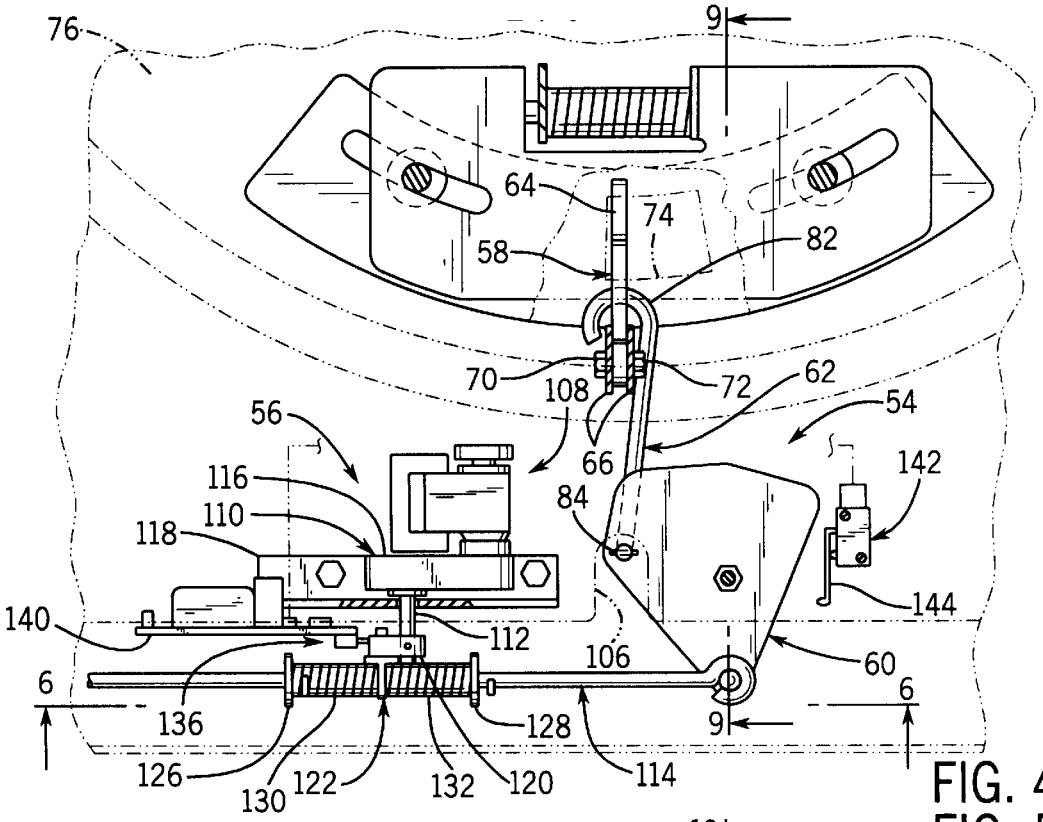
FIG. 4
FIG. 5
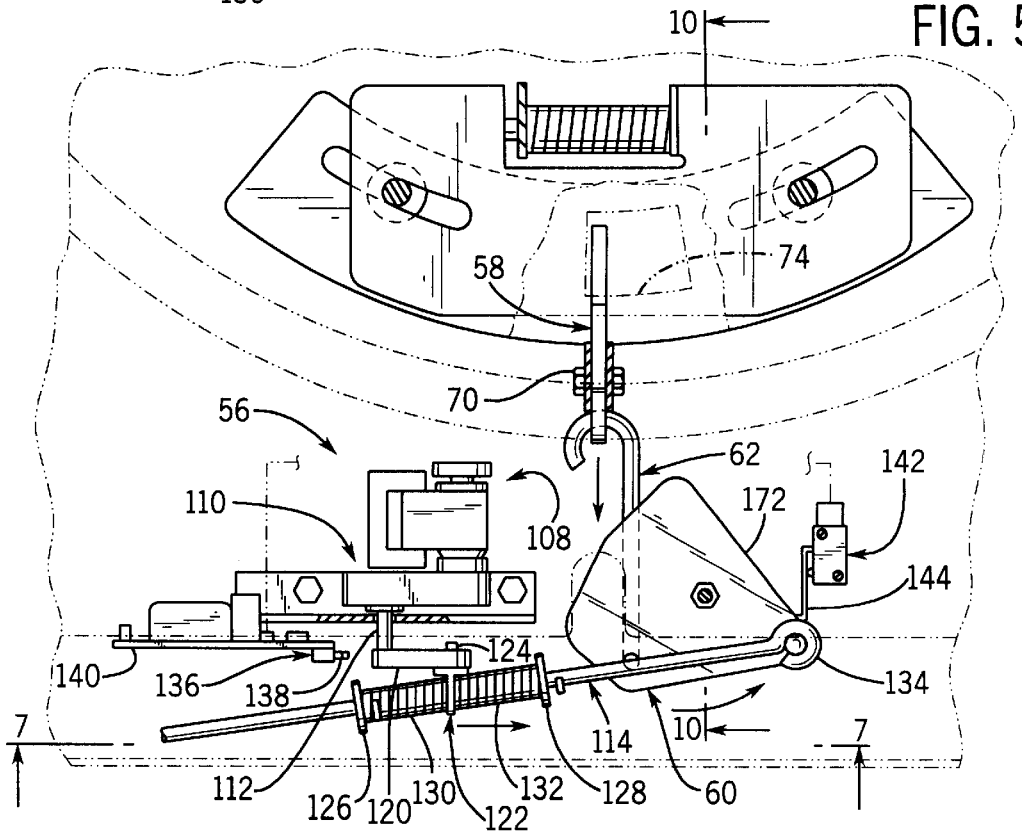

FIG. 6
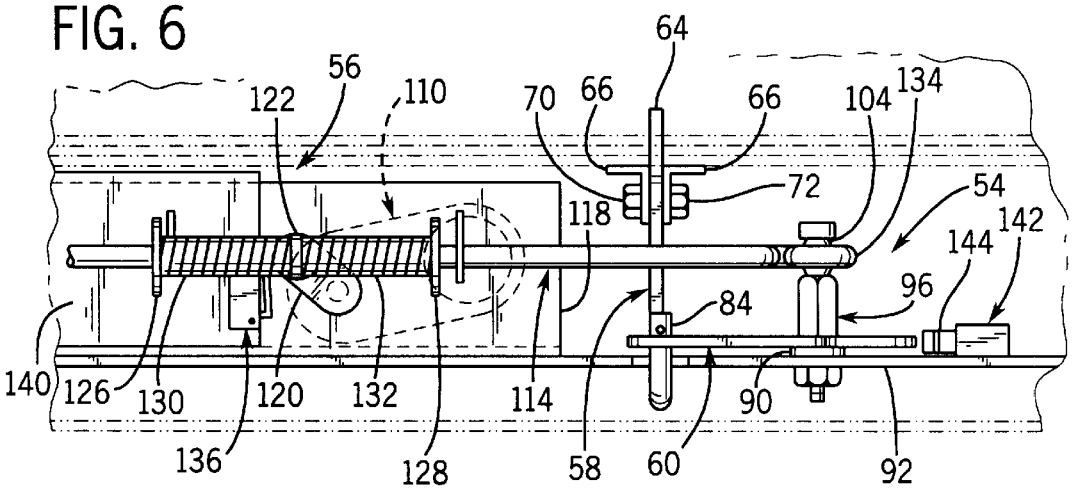
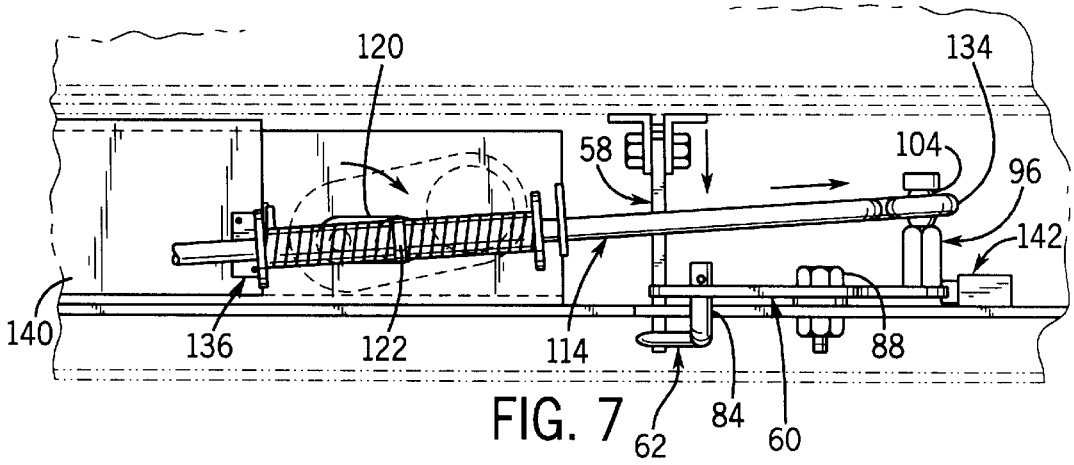
FIG. 7
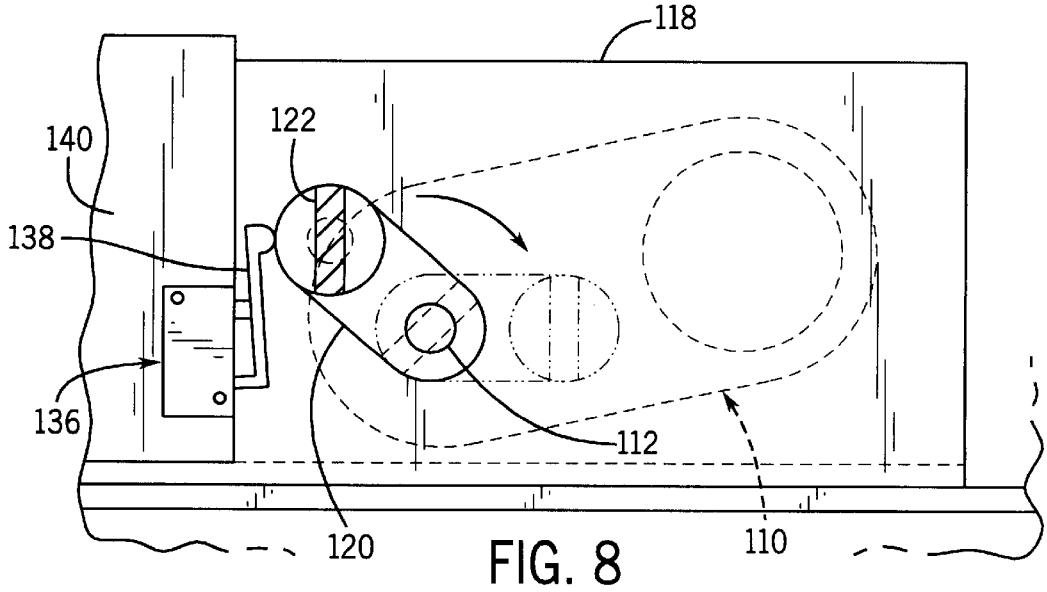
FIG. 8

ROTARY STORAGE UNIT WITH MOTORIZED LATCH ACTUATOR

BACKGROUND AND SUMMARY OF THE INVENTION

This invention relates to a rotary storage unit, and more particularly to a system for operating a latch mechanism associated with a rotary storage unit for selectively maintaining the storage unit in either an open position or a closed position.

Rotary storage units typically include a cabinet or enclosure defining an interior within which a rotary storage member, such as a shelf or cabinet assembly, is mounted. The storage member is mounted on a turntable, for providing rotation of the storage member within the cabinet interior. A latch mechanism is mounted to the cabinet, and includes a latch member which is selectively engageable with the storage member for maintaining the storage member in either an open position or a closed position. When the storage member is in the open position, a storage area of the storage member is accessible through an opening defined by the cabinet. When the storage member is in the closed position, access to the storage area of the storage member through the cabinet opening is prevented.

In the prior art, a depressible foot pedal actuator is mounted to the cabinet and is interconnected with the latch mechanism, for moving the latch mechanism from its latching position to its release position so as to allow the storage member to be rotated within the cabinet. As long as the foot pedal remains depressed, the latch mechanism is maintained in its release position so that the storage member can be freely rotated within the cabinet interior. When the foot pedal is released, the latch member is biased into engagement with the underside of the turntable, within which one or more openings are formed. When the storage member reaches either its open position or closed position, the latch member moves into one of the openings, so as to selectively maintain the storage member in either its open position or its closed position. While this construction provides satisfactory operation, it is somewhat disadvantageous in that foot action is required in order to release the latch mechanism, which can be a drawback for handicapped individuals. In addition, the foot pedal extends outwardly from the base of the cabinet, and can be accidentally encountered by persons walking past the rotary storage unit.

A hand-operated latch mechanism is disclosed in Poortvliet et al U.S. Pat. No. 5,494,347. The '347 patent includes a sliding hand actuator which is connected through a cable with a link and lever system, which in turn operates the latch member. An air cylinder retards return of the actuator and latch member to the latched position. While this arrangement overcomes some of the drawbacks of a foot pedal actuator, it involves use of a cable which can stretch over time. In addition, assembly is somewhat difficult and it is only possible to have a single actuator, which prevents the ability to have two-sided actuation. Further, the sliding hand actuator requires a certain amount of hand or finger strength to operate.

It is an object of the present invention to provide an improved hand-operated actuator mechanism for a rotary storage unit. It is a further object of the invention to provide such an actuator mechanism which incorporates a motor for operating the actuator mechanism and to move the latch member between its latching and release positions. Yet another object of the invention is to provide such an actuator mechanism which is capable of operation using a push-button switch arrangement, providing significant ease of operation. A still further object of the invention is to provide such an actuator mechanism which can be selectively enabled and disabled. A still further object of the invention is to provide such an actuator mechanism which incorporates a unique latch arrangement interconnecting an actuator motor with the latch member, and which incorporates a time delay feature for providing the user with sufficient time to commence rotation of the storage member when the latch member is in its release position. Yet another object of the invention is to provide such an actuator mechanism which is relatively simple in its construction, components and operation, and which can be easily incorporated into a rotary storage unit constructed generally similarly to prior art rotary storage units. A still further object of the invention is to provide such an actuator mechanism which can be operated from either side of the rotary storage unit.

In accordance with the invention, a rotary storage unit or assembly includes a cabinet or enclosure which defines an interior and at least one access opening providing access to the interior. An upstanding rotary storage member is disposed within the interior of the cabinet and is pivotably movable relative to the cabinet, for movement between an open position in which a storage area of the storage member is accessible through the opening, and a closed position in which the storage area is inaccessible from the opening. A latch mechanism is interposed between the cabinet and the storage member. The latch mechanism is movable between a latching position for selectively maintaining the storage member in either its open position or its closed position, and a release position for allowing movement of the storage member relative to the cabinet. A motorized actuator is interconnected with the latch mechanism for selectively moving the latch mechanism between its latching position and its release position. The motorized actuator is operable in response to operation of a switch arrangement interconnected with the cabinet.

The latch mechanism includes a pivotable latch member which is movable into an opening formed in the storage member when in its latching position, for preventing rotation of the storage member relative to the cabinet. The latch member is disengageable from the opening when in its release position, for allowing the storage member to be rotated. The motorized actuator includes a motor having an output member, and an actuating arrangement interposed between the motor output member and the latch member. The motor output member is rotatable, and the actuating mechanism includes an actuator rod which is axially movable in response to rotation of the motor output member, through an actuating link mounted to the motor output member and an engagement member interconnecting the actuating link with the actuator rod at a location offset from engagement of the actuating link with the motor output member. In one form, the engagement member is movable relative to the actuator rod, and is engageable with the actuator rod through a pair of compressible springs, each of which is engaged at one end with the engagement member and at an opposite end with a stop member secured to the actuator rod. With this arrangement, the motor can be operated to return the latch member toward its latching position when the latch member is out of alignment with the opening, and one of the springs biases the actuator rod toward a position urging the latch member toward its latching position. The latch member engages the surface of the storage member within which the opening is formed. In this manner, when the storage member is moved to either its open or closed position, such that the opening is in alignment with the latch member, the spring functions to move the latch member into the opening to its latching position to retain the storage member in either its open or closed position.

The motorized actuator is operated so as to maintain the latch mechanism in its release position for a predetermined period of time after the latch mechanism has been moved from its latching position to its release position. The predetermined time period provides the operator with sufficient time to commence rotation of the storage member. The motor is subsequently operated to return the latch mechanism toward its latching position as described above, such that the latch member moves to its latching position when the storage member attains a predetermined position relative to the cabinet.

The switch arrangement, which functions to operate the motor, is mounted to a wall of the cabinet. Preferably, the switch arrangement is located at waist height or at any other location which is easily accessible by the hands of the user. The switch arrangement may include a key-operated primary switch which selectively enables and disables a secondary switch, which in turn operates the motor. In double-sided models, i.e. those which have two, oppositely facing access openings, a secondary switch may be mounted to the cabinet adjacent each of the openings so that the cabinet can be opened from either side. In a preferred form, the secondary switch is a button-type switch which can be depressed to operate the motor and to move the latch mechanism to its release position.

The invention further contemplates an improvement in a rotary storage unit and a method of actuating a latch mechanism associated with a rotary storage unit, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 4 is a partial bottom plan view of a portion of the rotary storage unit of FIG. 1, showing the motorized actuator of the present invention as interconnected with a latch mechanism incorporated into the storage unit of FIG. 1 and showing the latch mechanism in a latching position;

FIG. 5 is a view similar to FIG. 4, showing operation of the motorized actuator of the present invention so as to move the latch mechanism to a release position;

FIG. 6 is a partial section view taken along line 6—6 of FIG. 4, showing the latch mechanism in its latching position;

FIG. 7 is a partial section view taken along line 7—7 of FIG. 5, showing the latch mechanism in its release position;

FIG. 8 is an enlarged partial section view showing a portion of the motorized actuator illustrated in FIGS. 6 and 7;

DETAILED DESCRIPTION OF THE INVENTION

Figure 1:
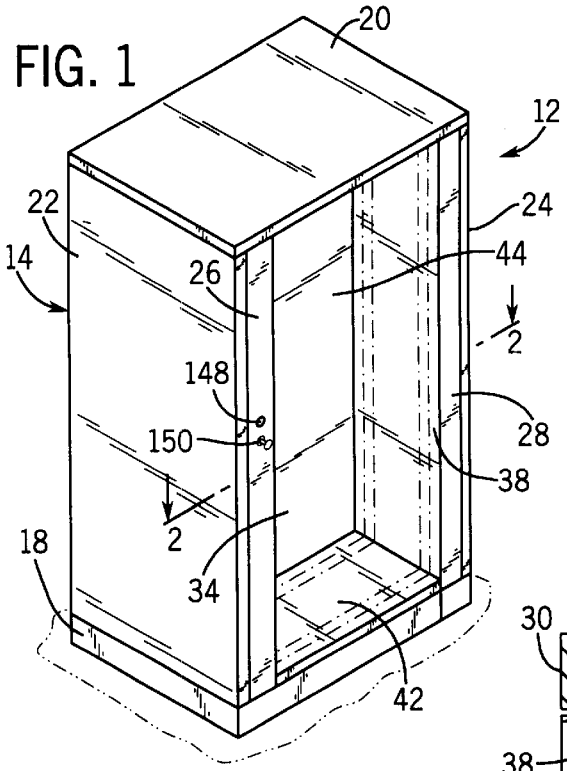
FIG. 1 is an isometric view illustrating a rotary storage unit or assembly incorporating the motorized actuator system of the present invention.

Referring to FIG. 1, a rotary storage unit or assembly 12 constructed according to the invention generally includes a cabinet or enclosure 14 and a rotary storage member 16. Cabinet 14 includes a base section 18, a top panel 20, and a pair of vertical sidewalls 22, 24 extending between base section 18 and top panel 20. Cabinet 14 further includes a pair of partial front panels 26, 28 and a pair of partial rear panels 30, 32. Cabinet 14 defines an interior which is accessible through an opening 34 located between partial front panels 26, 28, and through an opening 36 located between partial rear panels 30, 32.

Rotary storage member 16 includes a pair of sidewalls 38, 40, which extend between a bottom wall 42 and a top wall (not shown), located below cabinet top panel 20. Rotary storage member 16 further includes a central vertical divider wall 44. A pair of storage areas 46, 48 are defined by sidewalls 38, 40 on the opposite sides of divider wall 44, in combination with bottom wall 42 and the top wall of rotary storage member 16.

Storage member 16 is mounted to a rotary turntable, shown generally at 50. Turntable 50 is rotatably mounted to cabinet base 18 via a bearing arrangement, for providing rotation of rotary storage member 16 within the interior of cabinet 14.

Figure 2:
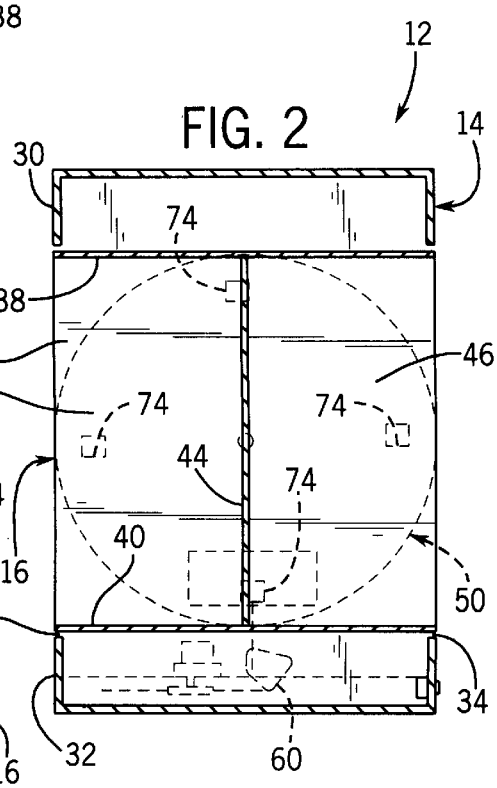
FIG. 2 is a section view taken along line 2—2 of FIG. 1, showing the rotary storage unit in an open position.
Figure 3:
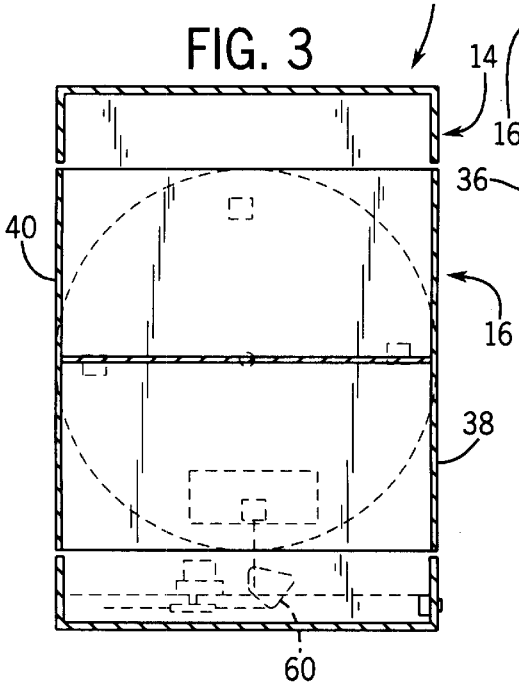
FIG. 3 is a view similar to FIG. 2, showing the rotary storage unit in a closed position.

Referring to FIG. 2, rotary storage member 16 can be moved relative to cabinet 14 to an open position, in which storage areas 46, 48 are accessible through openings 34, 36, respectively. Rotary storage member 16 can be rotated to a closed position as shown in FIG. 3, in which rotary storage member sidewalls 38, 40 occupy openings 34, 36, respectively, to prevent access to storage areas 46, 48. In a manner as is known, storage areas 46, 48 are adapted to receive shelves, drawers or the like, to contain articles within storage areas 46, 48.

The above-described general construction of rotary storage unit 12 is conventional and known in the art, and representatively may be that such as is available from Spacesaver Corporation of Fort Atkinson, Wis. under its designation PIVOTFILE.

Referring to FIGS. 4 and 6, a latch mechanism 54 is located within the interior of cabinet base section 18, and a motorized actuator arrangement 56 is interconnected with latch mechanism 54. In a manner to be explained, latch mechanism 54 and motorized actuator arrangement 56 are operable to selectively maintain rotatable storage member 16 in one or the other of its open and closed positions as illustrated in FIGS. 2 and 3, respectively, and to selectively allow rotation of rotatable storage member 16 relative to cabinet 14.

Figure 9:
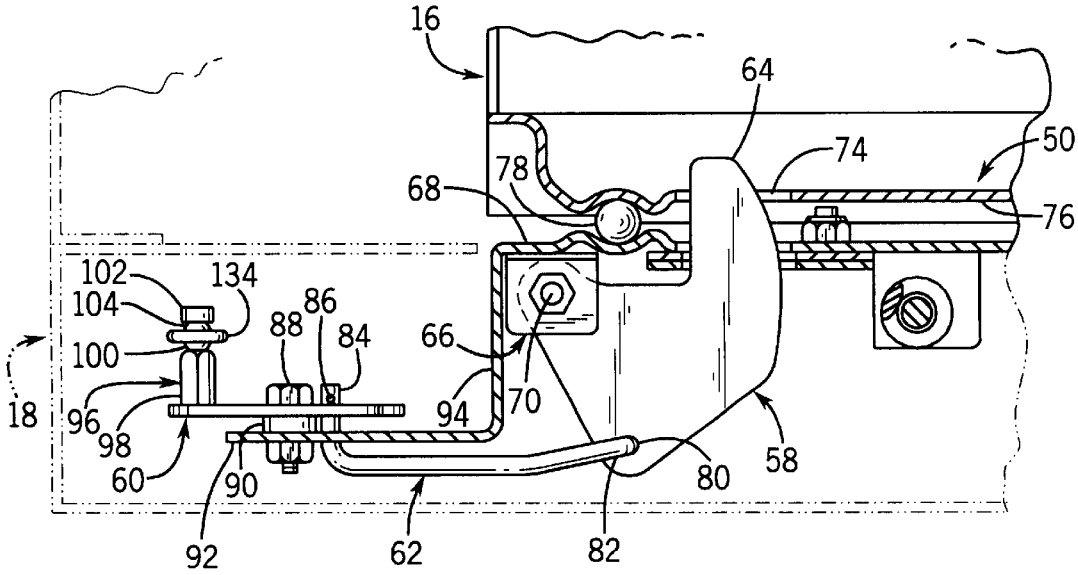
FIG. 9 is a partial section view taken along line 9—9 of FIG. 4.

As shown in FIGS. 4, 6 and 9, latch mechanism 54 includes a vertically oriented latch member 58, a horizontally oriented crank member 60, and a link 62 extending between and interconnecting latch member 58 and crank member 60. Latch member 58 includes an upstanding latch arm 64, and is mounted for pivotable movement about a horizontal pivot axis between a pair of latch member mounting brackets 66 secured to an upper wall 68 defined by base section 18. A pivot pin, in the form of a headed fastener 70, extends between brackets 66 and through an opening formed in latch member 58, to define the horizontal axis about which latch member 58 is pivotable. A retaining nut 72 is mounted to fastener 70 for maintaining engagement of fastener 70 with brackets 66.

FIGS. 4, 6 and 9 illustrate latch member 58 in a latching position, in which latch arm 64 extends into an opening 74 formed in a lower wall 76 defined by turntable 50. With latch member 58 in its latching position, engagement of latch arm 64 within opening 74 functions to prevent rotation of turntable 50 relative to base section 18, to maintain rotary storage member 16 in one of its open or closed positions. Referring to FIGS. 2 and 3, lower wall 76 of turntable 50 defines four openings 74, with each pair of openings 74 being located diametrically opposite one another. The locations of openings 74 are selected such that engagement of latch arm 64 within one of openings 74 maintains rotary storage member 16 at positions corresponding to every 90° of rotation of rotary storage member 16, and corresponding to either an open position or a closed position of rotary storage member 16.

Referring to FIG. 9, upper wall 68 of base section 18 and lower wall 76 of turntable 50 are formed with facing channels within which a series of ball-type bearing members 78 are located. In a manner as is known, bearing members 78 facilitate rotation of rotary storage member 16 relative to cabinet base section 18.

As shown in FIGS. 4 and 9, an aperture 80 is formed in the lower end of latch member 58. Link member 62 defines a hook section 82 at its inner end, which extends through aperture 80. At its outer end, link member 62 defines an upwardly extending connector section 84 which extends through an aperture formed in crank member 60. A horizontal retainer pin 86 extends through a passage formed toward the upper end of connector section 84, for maintaining engagement of connector section 84 with crank member 60.

Crank member 60 is pivotable relative to base section 18 by means of a vertically extending pivotable connection which includes a vertically oriented bolt 88 having a shank which extends through an aperture formed in crank member 60. The shank of bolt 88 extends through a spacer 90 located between crank member 60 and a horizontal end wall section 92, which is integrally formed with base section upper wall 68 and interconnected therewith via a vertical wall section 94. Spacer 90 is formed of a low friction material, such as nylon, and functions as a bearing member for accommodating pivoting movement of crank member 60.

A stud 96 is fixed to crank member 60, and extends upwardly therefrom. Stud 96 includes a lower section 98 defining a shoulder 100 and a head 102. An outwardly arcuate neck section 104 is located between shoulder 100 and head 102. Stud 96 is secured to crank member 60 in any satisfactory manner, such as by means of a countersunk screw extending upwardly through crank member 60 and into an upwardly extending threaded passage formed in lower section 98.

In a manner to be explained, motorized actuator arrangement 56 is interconnected with crank member 60 for pivoting crank member 60 about the vertical pivot axis defined by bolt 88, between first and second positions as shown in FIGS. 4 and 5, respectively. Horizontal end section 92 of base section upper wall 68 is formed with a recess 106 (FIGS. 4, 5), which accommodates movement of connector section 84 of link member 62 during such pivoting movement of crank member 60.

Referring to FIGS. 4–7, motorized actuator arrangement 56 generally includes a motor 108, a gear reducer 110 having an output shaft 112, and an actuator rod 114 engaged with output shaft 112 of gear reducer 110.

Motor 108 is of conventional construction, and includes a rotary output shaft which provides input power to the input of gear reducer 110. Representatively, motor 108 and gear reducer 110 may be a combination motor and gear reducer such as is available from Rex Engineering Corporation of Titusville, Fla. under its Model No. MBA9R10, although it is understood that any other satisfactory motor may be employed. Gear reducer 110 includes a gear reducer case 116, to which motor 108 is mounted in a conventional manner. Gear reducer case 116 is secured to the horizontal leg of a mounting bracket 118. The vertical leg of mounting bracket 118 includes an aperture through which gear reducer output shaft 112 extends.

An actuator link 120 is secured at its inner end to the outer end of gear reducer output shaft 112. An engagement member 122 is pivotably secured to the outer end of actuator link 120 via a mounting shaft 124 extending through a passage formed in actuator link 120.

Actuator rod 114 extends through an opening formed in engagement member 122, such that actuator rod 114 is slidably movable within and relative to engagement member 122. A pair of stops 126, 128 are fixedly mounted to actuator rod 114. A compressible spring 130 extends between stop 126 and engagement member 122, and a compressible spring 132 extends between stop 128 and engagement member 122. This construction provides a cushioned engagement arrangement between engagement member 122 and actuator rod 114.

At its outer end, actuator rod 114 includes an eye section 134 within which arcuate neck section 104 of stud 96 is received. This engagement of actuator rod 114 with stud 96 accommodates pivoting movement between actuator rod 114 and stud 96, as well as angular rotation of actuator rod 114 relative to stud 96.

Referring to FIGS. 5 and 8, a home switch assembly 136 having a depressible actuator 138 is mounted to a control board 140, which in turn is interconnected with the vertical leg of mounting bracket 118. Switch assembly 136 is oriented such that actuator 138 is in line with actuator link 120. In a similar manner, a position switch assembly 142 is mounted to horizontal wall end section 92, and includes an actuator 144 which is aligned with crank member 60. Motor 108 and switch assemblies 136, 142 are interconnected with control board 140 through conventional connections and wiring in a known manner. Switch assemblies 136, 142 representatively may be switch assemblies such as are available from Microswitch of Freeport, Ill. under its Model No. BZ-2RQ18-D5, although it is understood that other satisfactory switch assemblies may be employed.

Referring to FIG. 1, a depressible button-type actuator switch 148 is mounted to partial front panel 26 of cabinet 12. A key-type locking enable switch 150 is mounted to partial front panel 26 adjacent actuator switch 148. A similar actuator switch 148 and enable switch 150 may also be mounted to one or the other of partial rear panels 30, 32. Button-type actuator switch 148 is of conventional construction, and may be a switch such as is available from Apem Components, Inc. of Haverhill, Mass. under its Model No. 1443NC2. Enable switch 150 is also of conventional construction, and may be a switch such as is available from C and K Components, Inc. of Watertown, Mass. under its Model No. P1011U3WM03NQ2. It is understood that the designated manufacturers and model numbers are illustrative only, and that other satisfactory switch mechanisms may be employed.

Figure 11:
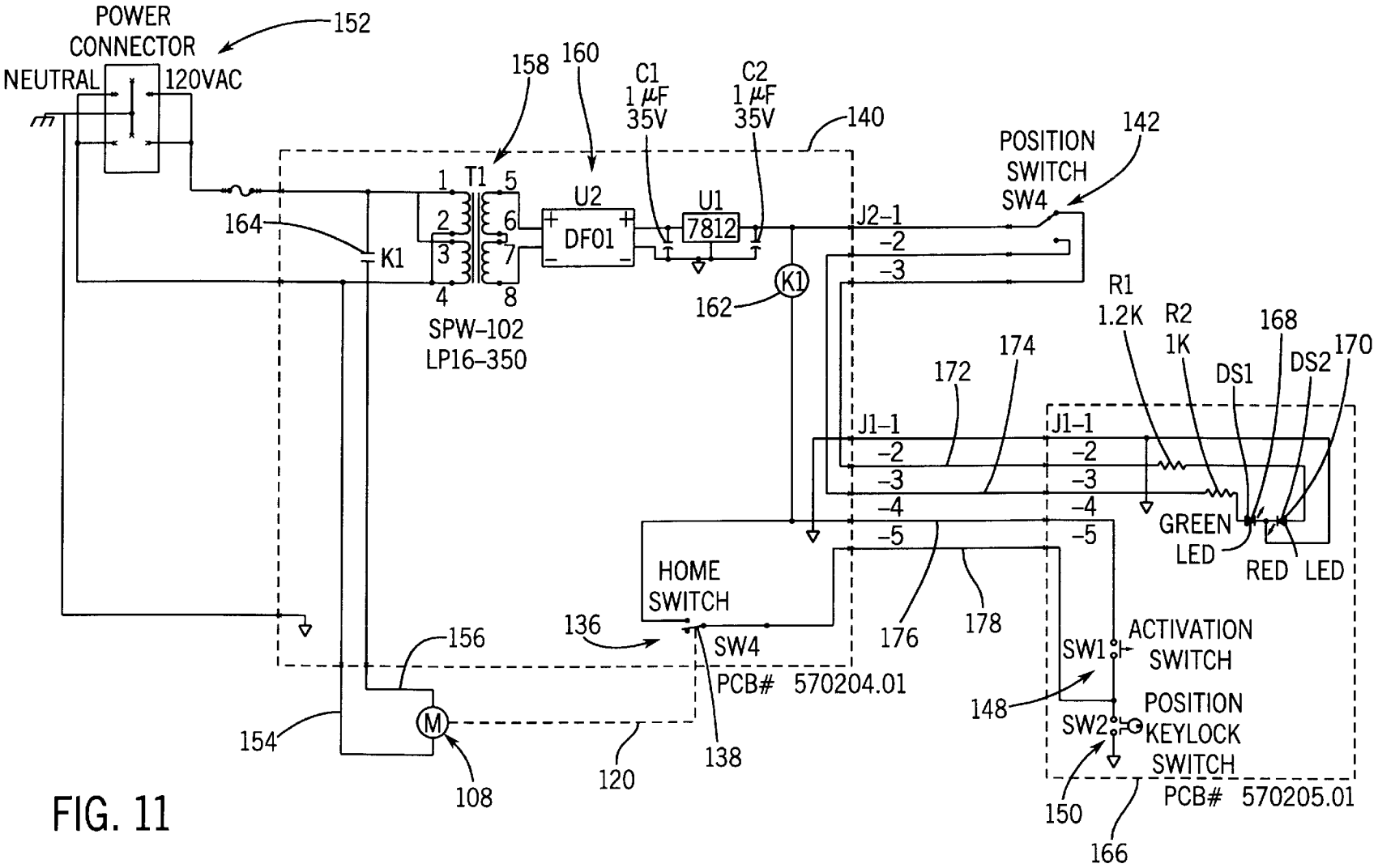
FIG. 11 is a schematic representation of the electrical system for operating the motorized actuator of the invention as incorporated into the rotary storage unit of FIG. 1.

FIG. 11 schematically illustrates the electrical system for operating motor 108 of actuator arrangement 56. A power supply 152 supplies 120 volt AC input power to control board 140, and to motor 108 through wires 154, 156. Control board 140 includes a transformer 158 interconnected with power supply 152, for providing 24 volt AC power to a DC power converter 160. Home switch 136 is mounted to control board 140, and a coil 162 having a contact 164 extends across home switch 136 and position switch 142, which in turn is interconnected with control board 140. FIG. 11 illustrates a dashed line emanating from motor 108 and interconnected with actuator 138 of home switch 136, which represents actuator link 120.

The right hand portion of FIG. 11 illustrates actuator switch 148 and enable switch 150, which are illustrated as mounted to a switch board 166 which is secured to the inside surface of partial front panel 26. Switch board 166 also includes a green LED 168 and a red LED 170. Wires 172, 174 interconnected LEDs 168, 170 with control board 140 and position switch 142. Wires 176, 178 interconnect actuator switch 148 with home switch 136. Enable switch 150 extends between actuator switch 148 and ground.

In operation, motorized actuator arrangement 56 is operable as follows to selectively enable and prevent rotation of storage member 16 within cabinet 14.

As noted previously, latch arm 64 of latch member 58 is normally disposed within one of openings 74 in turntable lower wall 76 to maintain storage member 16 in one of its open and closed positions. When it is desired to move storage member 16 to a different position, the user first operates key-type enable switch 150 so as to ground the electrical system and enable operation of motor 108 through actuator switch 148. The corresponds to an unlocked condition provided by enable switch 150. Actuator switch 148 is then closed, so as to actuate coil 162 and close coil contact 164. This provides power to motor 56 so as to initiate operation of motor 108, which results in rotation of gear reducer output shaft 112. Actuator link 120 is normally engaged with actuator 138 of home switch assembly 136, to maintain home switch assembly 136 in its open position. Upon operation of motor 108 and rotation of actuator link 120, home switch assembly 136 is closed.

Figure 10:
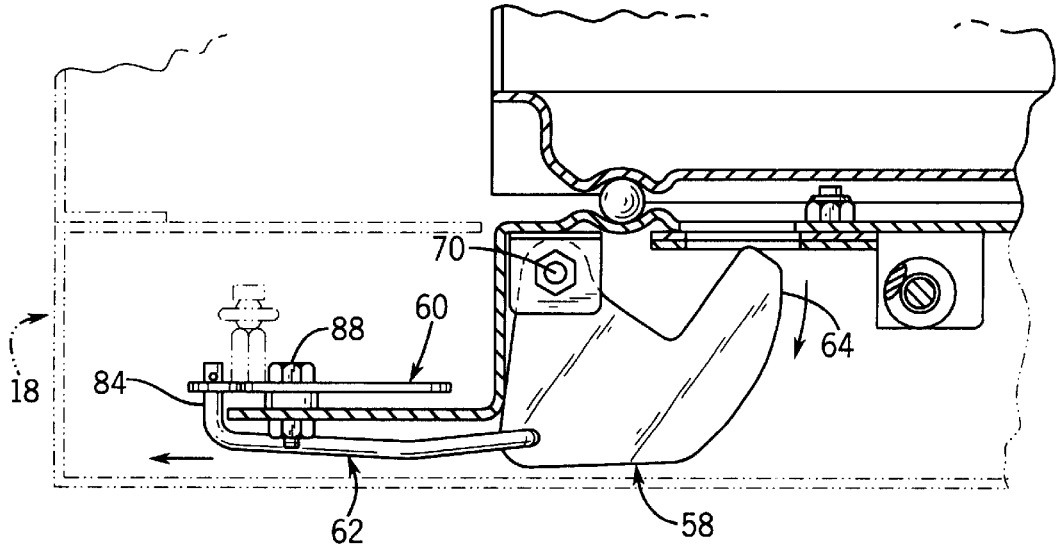
FIG. 10 is a partial section view taken along line 10—10 of FIG. 5.

Motor 108 is operated so as to pivot actuator link 120 about a pivot axis defined by gear reducer output shaft 112. This results in corresponding arcuate movement of engagement member 122, which is transferred to actuator rod 114 through engagement of spring 132 with stop 128. Actuator rod 114 is moved in an axial direction toward crank member 60. Such movement of engagement member 122 also results in angular movement of actuator rod 114 as shown in FIG. 7, which is accommodated by engagement of eye section 134 with neck section 104 of stud 96. Such axial movement of actuator rod 104 causes counterclockwise rotation of crank member 60, with reference to FIGS. 4 and 5, which pulls link member 62 leftwardly (with reference to FIG. 10), causing latch member 58 to pivot about the pivot axis defined by fastener 70. This results in downward movement of latch arm 64 out of opening 74, to allow the user to rotate storage member 16 within cabinet 14.

Crank member 60 is moved by engagement with actuator rod 114 to a position as shown in FIG. 5, in which an edge of crank member 60, shown at 172, engages actuator 144 of position switch assembly 142. Normally, power is supplied through position switch assembly 142 to wire 172 and to red LED 170, to provide an indication that latch mechanism 54 is in its latching position. When the edge of crank member 60 engages position switch assembly 142, power to red LED 170 is cut off and power is supplied to green LED 160 through wire 172. This provides a visual indication to the operator that latch mechanism 54 is in its release position, and the user then is able to rotate storage member 16. Operation of motor 108 continues so as to continue rotation of actuator link 120, resulting in axial, pivoting and angular movement of actuator rod 114 to maintain crank member 60 in a counterclockwise pivoted position and to maintain latch arm 64 in its release position. Continued operation of motor 108 results in rotation of actuator link 120, to move crank member 60 back in a clockwise direction so as to push latch member 58 back toward its latching position through link member 62. This results in disengagement of crank member edge 172 from position switch 142, which returns power through line 172 to red LED 170, to indicate that latch mechanism 54 is no longer in its release position. Simultaneously, power to green LED 168 is cut off so that green LED 168 is no longer illuminated. Continued operation of motor 108 results in subsequent engagement of actuator link 120 with actuator 138 of home switch assembly 136. This returns home switch assembly 136 to its open position, which deenergizes coil 162 and opens coil contact 164, to cut off the supply of power to motor 108. In this manner, latch mechanism 54 is cycled from its latching position to its release position, and subsequently from its release position back toward its latching position.

The full revolution of actuator link 120 provides a time delay during which latch mechanism 54 is moved out of its latching position so as to enable rotatable storage member 16 to be rotated. Representatively, rotation of gearbox output shaft 112 is timed so as to provide an approximately 4–5 second window before latch mechanism 54 is returned toward its latching position by revolution of actuator link 120. Within the predetermined time period, the user commences rotation of storage member 16 within cabinet 14, such that opening 74 is moved out of alignment with latch arm 64. When latch member 58 is returned toward its latching position as described above, the upper end of latch arm 64 engages the underside of lower wall 76. When actuator link 120 is moved back to its FIG. 4 position in this manner, spring 130 is compressed due to the inability of latch member 58 to fully return to its latching position. In this manner, latch member 58 is biased by spring 130 toward its latching position such that, when storage member 16 is rotated to a position in which either a storage area or a wall is in line with the cabinet opening, the next opening 74 has come into alignment with latch arm 64 and latch arm 64 is moved into the opening 74 under the influence of spring 130. The upper end of latch arm 64 thus rides along the underside of lower wall 76 until rotary storage member 16 attains a predetermined position, at which time latch member 58 is moved into the opening 74 under the influence of spring 130. If the user again desires to rotate storage member 16, the above-described sequence is repeated so as to withdraw latch arm 64 from opening 74 and to enable subsequent rotation of rotary storage member 16.

At any time, enable switch 150 may be operated so as to stop or prevent operation of motor 108 so as to maintain latch mechanism 54 in a desired position. For example, when latch mechanism 54 is in its latching position, movement of enable switch 150 to its locked condition will prevent operation of motor 108 to move latch mechanism 54 away from its latching position, to lock rotatable storage member 16 in either an open position or a closed position. Likewise, enable switch 150 may be operated to cut off power to motor 108 when motor 108 has been operated so as to move latch mechanism 54 to its release position. This enables free pivoting movement of rotatable storage member 16 within cabinet 14 to any desired position.

FIG. 11 illustrates a single switchboard 166, which provides actuator switch 148 and enable switch 150 on one side of cabinet 14. To operate actuator arrangement 56 from the opposite side of cabinet 14, a switchboard 166 is mounted to either one or partial rear panels 30, 32, without enable switch 150. A similar actuator switch, green LED and red LED arrangement is provided, and similar wires 172–178 are interconnected with the connector to control board 140 in parallel to wires 172–178, for providing dual sided actuation.

In rare occasions, such as during a power outage or due to a failure of motor 108, it may be desirable to move latch mechanism 54 away from its latching position so as to enable rotary storage member 16 to be moved to either its open position or its closed position. To accommodate this contingency, an opening is formed in a wall of space 18, and is typically closed by a plug member which may be provided with a lock which is keyed the same as enable switch 150. The opening is in alignment with the end of actuator rod 114, so that a tool can be engaged with actuator rod 114 to enable the user to push actuator rod 114 axially from its FIG. 4 position to its FIG. 5 position, to move latch arm 64 outwardly of opening 74 and to allow rotation of rotary storage member 16.

Motorized actuator arrangement 56 has been described with respect to the provision of rotary output power which is translated into linear motion of actuator rod 116. It should be understood that motor 56 may be replaced with a different actuator mechanism which provides linear output power, such as a linear actuator, to provide linear movement of actuator rod 114.

It can thus be appreciated that the invention provides a relatively simple motorized actuator mechanism for a rotary storage unit, which involves latching components similar to those in the prior art while adapting a motorized actuator mechanism. The motorized actuator mechanism provides advantages in easy push-button operation by a user, and also facilitates provision of a positive latch action when the rotary storage unit is pivoted to a desired position.

Various alternatives and embodiments are contemplated as being within the scope of the following claims particularly pointing out and distinctly claiming the subject matter regarded as the invention.

We claim:

1. A rotary storage assembly, comprising:

a cabinet defining an interior and at least one access opening providing in access to the interior;

an upstanding rotary storage member disposed within the cabinet interior, wherein the rotary storage member is mounted for pivoting movement relative to the cabinet about an upright pivot axis for movement between an open position in which a storage area of the storage member is accessible through the opening, and a closed position in which the storage area is inaccessible from the opening;

a latch mechanism interposed between the cabinet and the storage member, wherein the latch mechanism is movable between an engaged position for selectively maintaining the storage member in a selected one of the open and closed positions, and a release position for selectively allowing movement of the storage member relative to the cabinet; and an actuator mechanism interconnected with the latch mechanism, wherein the actuator mechanism includes a motor having an output member interconnected with the latch mechanism, and a manually operable switch arrangement secured to the cabinet and interconnected with the motor, wherein the switch arrangement is operable to selectively operate the motor, and wherein operation of the motor causes movement of the motor output member to move the latch mechanism via the actuator mechanism between the engaged position and the release position.

2. The rotary storage assembly of claim 1, wherein the latch mechanism includes a pivotable latch member and wherein the motor output member functions to pivot the latch member between the engaged and release positions.

3. The rotary storage assembly of claim 1, further comprising a manually operable override arrangement associated with the actuator mechanism and an override opening associated with the cabinet, wherein the override arrangement is accessible through the override opening for enabling operation of the actuator mechanism to move the latch mechanism between the latching and release positions in the event the motor is rendered inoperable.

4. The rotary storage assembly of claim 1, wherein the latch mechanism includes a pivotable latch member, and wherein the actuator mechanism includes an axially movable actuator rod interconnected with the motor output member and interconnected with the pivotable latch member, wherein operation of the motor results in axial movement of the actuator rod, and wherein axial movement of the actuator rod causes movement of the latch member between the engaged and release positions.

5. The rotary storage assembly of claim 4, wherein the motor output member is engaged with the actuator rod via an engagement member secured to the actuator rod and movable therewith in response to movement of the motor output member.

6. In a rotary storage device including an enclosure defining an interior and an access opening, and an upstanding rotatable storage member disposed within the interior and including a storage area, wherein rotation of the storage member within the interior of the enclosure functions to move the storage member between an open position in which the storage area is accessible through the opening of the enclosure, and a closed position in which the storage member is inaccessible through the opening of the enclosure, and wherein the rotary storage device further includes a latch mechanism interposed between the enclosure and the storage member, wherein the latch mechanism is movable between a latching position in which the latch mechanism is engaged with the storage member for selectively maintaining the storage member in one of the open and closed positions, and a release position in which the latch mechanism is disengaged from the storage member for allowing rotation of the storage member relative to the enclosure, the improvement comprising a motorized actuator mechanism interconnected with the latch mechanism, wherein the motorized actuator mechanism includes a motor and a movable output member interconnected with the latch mechanism, and a switch member mounted to the enclosure and interconnected with the motor, wherein operation of the motor functions to move the motor output member so as to move the latch mechanism between the latching and release positions, wherein the latch mechanism includes a pivotable latch member, and wherein the motorized actuator mechanism further includes a pivotable crank member, a link interconnecting the pivotable crank member with the latch member, and an axially movable actuator rod interconnected with the crank member, wherein the motor output member is interconnected with the actuator rod, wherein operation of the motor results in axial movement of the actuator rod to move the latch member between the latching and release positions through the crank member and the link member.

7. The improvement of claim 6, wherein the motor output member is rotatable in response to operation of the motor, and wherein the actuator rod is axially movable via an actuator link defining a first end interconnected with the motor output member and a second end interconnected with the actuator rod at a location offset from the motor output member.

8. The improvement of claim 7, wherein the actuator link is interconnected with the actuator rod via an engagement member interconnected with and between the actuator link and the actuator rod.

9. The improvement of claim 8, wherein the engagement member is interconnected with the actuator rod via a compressible spring arrangement, and wherein the latch member in its latching position is received within an opening associated with the rotatable storage member, wherein operation of the motor to move the link and the engagement member so as to place the latch member in its latching position results in engagement of the latch member with a surface of the rotatable storage member out of alignment with the opening, and wherein the compressible spring arrangement urges the latch member toward its latching position such that, when the opening is moved into alignment with the latch member, the latch member is biased under the force of the spring arrangement into the opening.

10. A rotary storage assembly, comprising:

a cabinet defining an interior and at least one access opening providing access to the interior; p1 an upstanding rotary storage member disposed within the cabinet interior, wherein the rotary storage member is mounted for pivoting movement relative to the cabinet about an upright pivot axis for movement between an open position in which a storage area of the storage member is accessible through the opening, and a closed position in which the storage area is inaccessible from the opening;

a latch mechanism interposed between the cabinet and the storage member, wherein the latch mechanism is movable between an engaged position for selectively maintaining the storage member in a selected one of the open and closed positions, and a release position for selectively allowing movement of the storage member relative to the cabinet; and an actuator mechanism interconnected with the latch mechanism, wherein the actuator mechanism includes a motor having an output member interconnected with the latch mechanism, and a manually operable switch arrangement secured to the cabinet and interconnected with the motor, wherein the switch arrangement is operable to selectively operate the motor, and wherein operation of the motor causes movement of the motor output member to move the latch mechanism via the actuator mechanism between the engaged position and the release position, wherein the manually operable switch arrangement includes a first switch member interconnected with the motor for operating the motor to move the latch mechanism from the engaged position to the release position, and a second switch member for enabling operation of the first switch member.

11. In a rotary storage device including an enclosure defining an interior and an access opening, and an upstanding rotatable storage member disposed within the interior and including a storage area, wherein rotation of the storage member within the interior of the enclosure functions to move the storage member between an open position in which the storage area is accessible through the opening of the enclosure, and a closed position in which the storage member is inaccessible through the opening of the enclosure, and wherein the rotary storage device further includes a latch mechanism interposed between the enclosure and the storage member, wherein the latch mechanism is movable between a latching position in which the latch mechanism is engaged with the storage member for selectively maintaining the storage member in one of the open and closed positions, and a release position in which the latch mechanism is disengaged from the storage member for allowing rotation of the storage member relative to the enclosure, the improvement comprising a motorized actuator mechanism, wherein the motorized actuator mechanism includes a motor having a movable output member, an actuator mechanism interconnected between the motor output member and the latch mechanism, and a switch member mounted to the enclosure and interconnected with the motor, wherein the switch member provides selective operation of the motor to impart movement to the motor output member, and wherein movement of the motor output member causes the actuator mechanism to move the latch mechanism between the latching and release positions.

12. In a rotary storage device including an enclosure defining an interior and an access opening, and an upstanding rotatable storage member disposed within the interior and including a storage area, wherein rotation of the storage member within the interior of the enclosure functions to move the storage member between an open position in which the storage area is accessible through the opening of the enclosure, and a closed position in which the storage member is inaccessible through the opening of the enclosure, and wherein the rotary storage device further includes a latch mechanism interposed between the enclosure and the storage member, wherein the latch mechanism is movable between a latching position in which the latch mechanism is engaged with the storage member for selectively maintaining the storage member in one of the open and closed positions, and a release position in which the latch mechanism is disengaged from the storage member for allowing rotation of the storage member relative to the enclosure, the improvement comprising a motorized actuator mechanism, wherein the motorized actuator mechanism includes a motor having a movable output member, an actuator mechanism interconnected between the motor output member and the latch mechanism, and a switch member mounted to the enclosure and interconnected with the motor, wherein the switch member provides selective operation of the motor to impart movement to the motor output member, and wherein movement of the motor output member causes the actuator mechanism to move the latch mechanism between the latching and release positions, wherein the motor is operably configured to provide a time delay subsequent to operation of the switch member to operate the motor so as to return the latch mechanism from the release position to the latching position, wherein the time delay functions to temporarily maintain the latch mechanism in the release position prior to operation of the motor so as to return the latch mechanism to the latching position.

13. The improvement of claim 12, wherein the motor output member is interconnected with the latch mechanism via a spring mechanism.

14. The improvement of claim 13, wherein the latch mechanism includes a latch member adapted for engagement within an opening associated with the rotatable storage member, wherein, when the storage member is moved to a position in which the latch member is out of alignment with the opening and the motor is operated to move the latch mechanism from its release position toward its latching position after the predetermined time period, the latch mechanism engages a surface associated with the rotatable storage member such that, when the rotatable storage member is moved such that the opening is moved into alignment with the latch member, the force of the spring mechanism urges the latch mechanism to its latching position within the opening.

15. A rotary storage assembly, comprising:

a cabinet defining an interior and at least one access opening providing access to the interior;

an upstanding rotary storage member disposed within the cabinet interior, wherein the rotary storage member is mounted for pivoting movement relative to the cabinet about an upright pivot axis for movement between an open position in which a storage area of the storage member is accessible through the opening, and a closed position in which the storage area is inaccessible from the opening;

a latch mechanism interposed between the cabinet and the storage member, wherein the latch mechanism includes a pivotable latch member that is movable between an engaged position for selectively maintaining the storage member in a selected one of the open and closed positions, and a release position for selectively allowing movement of the storage member relative to the cabinet, and a motorized actuator interconnected with the latch mechanism for selectively moving the latch mechanism between the engaged position and the release position, wherein the motorized actuator includes a manually operable switch arrangement interconnected with the cabinet;

a motor having a movable output member; and an axially movable actuator rod interconnected with the motor output member and interconnected with the pivotable latch member, wherein operation of the motor results in axial movement of the actuator rod, and wherein axial movement of the actuator rod causes movement of the latch member between the engaged and release positions, wherein the motor output member is engaged with the actuator rod via an engagement member secured to the actuator rod and movable therewith in response to movement of the motor output member, wherein the engagement member is interconnected with the actuator rod by means of a pair of oppositely extending springs, each of which is engaged at one end with the engagement member and at an opposite end with the actuator rod.

16. The rotary storage assembly of claim 15, wherein the engagement member is interconnected with an actuating link secured to the motor output member, wherein the motor output member is rotatable so as to cause rotating movement of the actuating link and thereby the engagement member, wherein the engagement member is offset from the location at which the actuating link is engaged with the rotatable motor output member so as to cause axial movement of the actuator rod in response to rotation of the motor output member.

17. A rotary storage assembly, comprising:

a cabinet defining an interior and at least one access opening providing access to the interior;

an upstanding rotary storage member disposed within the cabinet interior, wherein the rotary storage member is mounted for pivoting movement relative to the cabinet about an upright pivot axis for movement between an open position in which a storage area of the storage member is accessible through the opening, and a closed position in which the storage area is inaccessible from the opening;

a latch mechanism interposed between the cabinet and the storage member, wherein the latch mechanism includes a pivotable latch member and is movable between an engaged position for selectively maintaining the storage member in a selected one of the open and closed positions, and a release position for selectively allowing movement of the storage member relative to the cabinet, and a motorized actuator interconnected with the latch mechanism for selectively moving the latch mechanism between the engaged position and the release position, wherein the motorized actuator includes a manually operable switch arrangement interconnected with the cabinet, a motor having a rotatable output member, and an actuator mechanism interconnected between the motor output member and the pivotable latch member, wherein movement of the motor output member functions to move the latch member between the engaged and release positions through the actuator mechanism, and wherein the actuator mechanism includes a pivotable crank member, a link interconnecting the crank member with the latch member, and an actuator rod interconnected between the motor output member and the crank member.

18. The rotary storage assembly of claim 17, wherein the actuator rod is interconnected with the motor output member via an actuating link engaged with the motor output member, wherein the actuating link is interconnected with the actuator rod in an offset fashion such that rotation of the actuating link causes axial movement of the actuator rod.

19. The rotary storage assembly of claim 18, wherein the actuator rod is interconnected with the crank member via a joint construction which accommodates angular movement of the actuator rod caused by rotation of the actuating link.

* * * * *

UNITED STATES PATENT AND TRADEMARK OFFICE

CERTIFICATE OF CORRECTION

PATENT NO. : 6,604,797 B2 
DATED : August 12, 2003
INVENTOR(S) : Steven M Lehmann et al.

It is certified that error appears in the above-identified patent and that said Letters Patent is hereby corrected as shown below:

Column 9,
Line 55, after "providing" delete "in";

Column 11,
Line 38, after "interior;" insert new paragraph;

Column 13,
Lines 42-43, after "cabinet;" delete new paragraph.

Signed and Sealed this

Second Day of December, 2003

JAMES E. ROGAN
*Director of the United States Patent and Trademark Office*